United States Patent [19]

Müller

[11] 4,050,481

[45] Sept. 27, 1977

[54] UNDULATED SHED LOOM WITH ELECTROMAGNETIC SHUTTLE DRIVE

[75] Inventor: Walter Müller, Tann-Ruti, Switzerland

[73] Assignee: Ruti Machinery Works Ltd., Ruti, Switzerland

[21] Appl. No.: 617,688

[22] Filed: Sept. 29, 1975

[30] Foreign Application Priority Data

Oct. 24, 1974 Switzerland ..... 14223/74

[51] Int. Cl.[2] ..... D03D 47/26; D03D 49/44

[52] U.S. Cl. ..... 139/436; 139/134; 139/188 R

[58] Field of Search ..... 139/12, 13, 133, 134, 139/134.5, 371, 436, 191, 190, 188; 310/12-15

[56] References Cited

U.S. PATENT DOCUMENTS

| | | | |
|---|---|---|---|
| 2,845,093 | 7/1958 | Dietzch et al. | 139/12 |
| 3,114,398 | 12/1963 | Pfarrwaller | 139/134 X |
| 3,298,401 | 1/1971 | Stutz | 139/371 |
| 3,618,640 | 11/1971 | Linka | 139/134 |
| 3,705,606 | 12/1972 | Stucki | 139/191 X |
| 3,750,713 | 8/1973 | Titov | 139/191 X |
| 3,881,523 | 5/1975 | Paton et al. | 139/12 |

FOREIGN PATENT DOCUMENTS

| | | | |
|---|---|---|---|
| 989,730 | 5/1971 | France | 139/134 |
| 728,660 | 4/1932 | France | 310/12 |
| 2,311,780 | 9/1974 | Germany | 139/134 |
| 2,111 of | 1854 | United Kingdom | 139/134 |
| 872,072 | 7/1961 | United Kingdom | 310/15 |
| 1,344,517 | 1/1974 | United Kingdom | 310/15 |

*Primary Examiner*—James Kee Chi
*Attorney, Agent, or Firm*—Donald D. Denton

[57] ABSTRACT

The present invention relates to an undulated shed-type loom for transporting shuttles filled with filling thread through sheds by means of electromagnetic fields acting on the shuttles and having means for beating up the filling threads introduced against the fell of the cloth, the beating-up of the filling threads taking place synchronously with the transportation of the shuttles over the width of the loom.

16 Claims, 17 Drawing Figures

UNDULATED SHED LOOM WITH ELECTROMAGNETIC SHUTTLE DRIVE

BACKGROUND OF THE INVENTION

Undulated shed looms with electromagnetic shuttle drive are already known. In previously known shuttle drives of this type there is the danger that the synchronism between the beating up of the filling threads and the transporting of the shuttles is lost. As a result, there can be relative displacements of the shuttles with respect to each other or shuttles may even drop out of the field of force. Disturbances of this kind, for instance, can occur in case of increased rubbing of the warp yarns against the shuttles, upon the catching of a filling yarn in the warp yarns, or in case of a sudden stopping of the loom.

Also in one known magnetic drive device for the shuttles of an undulated shed loom, the shuttles are made in disk shape and are transported through the sheds by means of a conveyor belt which is provided with electromagnets. Due to the use of electromagnets, the magnets and the shuttles become very warm, and special cooling elements may have to be installed which means an increase in expense. Furthermore, the fact that the feeding of the electric current must be effected to magnets which are constantly in motion means an additional expense.

The closest prior art known to the applicant in connection with this application is in the British Pat. No. 742,060 and the German Pat. No. 1,020,578.

SUMMARY OF THE INVENTION

One of the objects of the invention is to avoid the above-mentioned disadvantages of loss of synchronism, and the invention is characterized by coupling means acting between the shuttles and the stop means in order to maintain the synchronous operation between the transporting of the shuttles and the beating-up movement of the beating-up means.

The present invention furthermore relates to an arrangement for the transporting of shuttles filled with filling thread through the sheds of an undulated shed loom by means of magnetic fields acting on ferromagnetic parts contained in the shuttles, by which fields the shuttles can be driven along their path. Thus the invention avoids the further disadvantages set forth above and is characterized by permanent magnets arranged movably along the path of the shuttles at fixed distances apart which are less than the length of a shuttle (said permanent magnets being hereinafter referred to as "drive magnets") and by drive means associated with these drive magnets, by which means the drive magnets can be moved in such a manner that local magnetic fields of varying intensity having a resultant component of force lying in the direction of movement of the shuttles on their ferromagnetic parts are present over the entire weaving width.

By the use of permanent magnets as drive elements for these shuttles, the transport of the shuttles takes place by mutual attraction and repulsion of magnetic poles. No feeding of electric current to the magnets is necessary and no undesired heating of the magnets takes place. In the present state of technology of permanent magnet materials, permanent magnets can be used for practically an unlimited period of time without any decrease or loss of their magnetic properties occurring and they furthermore require no maintenance.

One preferred embodiment of the arrangement in accordance with the invention is characterized by the fact that the drive magnets are arranged along two opposite sides of the path of the shuttles and are movable synchronously with each other on both sides and that each of the shuttles is equipped with at least two permanent magnets, hereinafter referred to as shuttle magnets.

Due to the fact that the shuttles are exposed on two sides of the path of conveyance to the action of the drive magnets, not only is particularly good efficiency obtained but all unilateral action on the driving of the shuttles is avoided. The equipping of the shuttles with the shuttle magnets also increases the efficiency of the shuttle movement and provides assurance that there will be no heating of the shuttles caused by magnetic pole reversals.

BRIEF DESCRIPTION OF THE DRAWINGS

These and other objects will become apparent from the following description of illustrative examples with reference to the drawings, in which.

DESCRIPTION OF THE PREFERRED EMBODIMENTS

Figure 3:
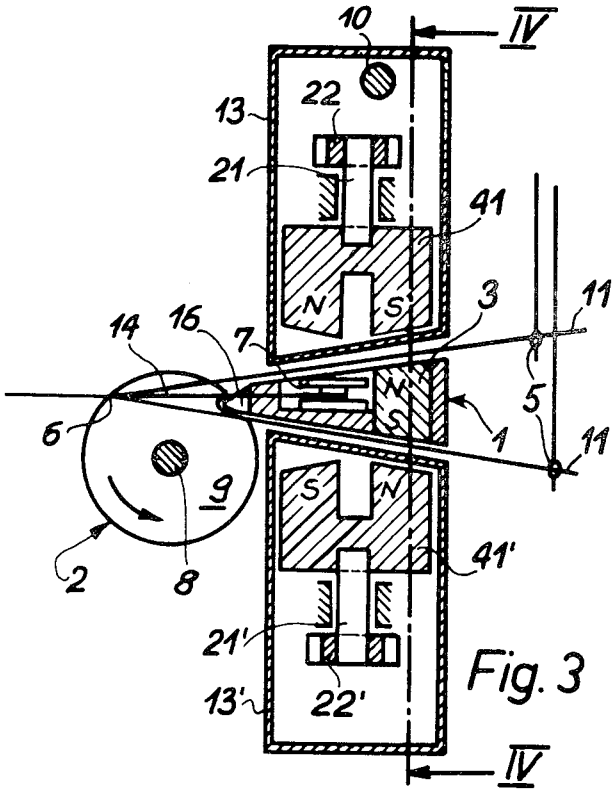
FIG. 3 is a vertical view in cross-section similar to that shown in FIG. 1, of another embodiment.
Figure 1:
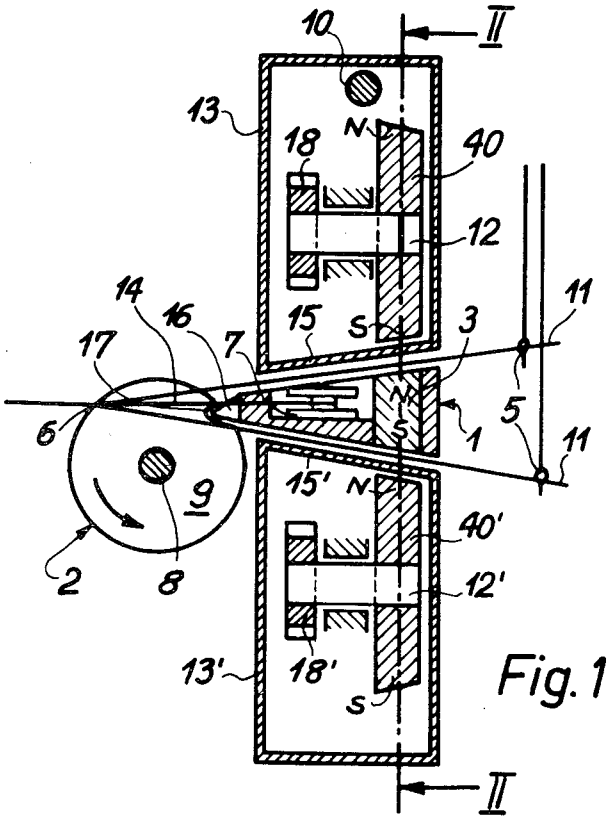
FIG. 1 is a vertical view in cross-section through a shed of an undulated shed-type loom.

FIG. 1 illustrates a shuttle 1 with its corresponding drive and a rotary reed 2 for the beating up of the filling threads.

The warp threads 11 are tensioned between heddles 5 and the fell of the cloth 6. The shuttles 1 each introduces a filling thread into the shed formed by the warp threads 11, the filling thread being withdrawn from a bobbin 7 which is rotatably supported in the shuttle 1.

The rotary reed 2 consists essentialy of a plurality of reed disks 9 mounted fixed in position equal distances apart on a drive shaft 8 and in operation it rotates in the direction indicated by an arrow. All reed disks 9 which have the same shape (not shown in detail) are in known manner continuously spaced apart in direction of rotation by the same central angle over the entire width of the loom. Thus corresponding points on the periphery of the individual reed disks 9 lie along a helix which extends on the periphery of the rotary reed 2, said helix having a given pitch and the reed disks 9 in operation produce a helical movement which is propagated in the direction of transport of the shuttles 1. The movement of the heedles 5 takes place in such a manner that each shuttle 1 during its movement for the introduction of the filling thread passes continuously through an open shed and a change of shed takes place between every two shuttles. The undulated movement of the heddles 5 and thus of the sheds, the helical movement produced by the reed disks 9 and the movement of translation of the shuttles 1 are so synchronized to each other that associated components are in each case in phase. In other words, the speed of propagation of the undulating movement of the sheds, the speed of propagation of the helical movement produced by the reed disks 9 and thus of the beating up of the filling threads and the speed of translation of the shuttles 1 upon the introduction of the filling thread are the same.

The shuttles 1, as shown in the drawing, are of trapezoidal cross-section, the sides of the trapezoid extending parallel to the warp threads 11 when the shed is open. As already mentioned, each of the shuttles 1 bears or has a rotatably supported bobbin 7 from which would filling thread 14 is withdrawn upon the introduction of the filling thread into the shed of the loom. On the side of the shuttles 1 facing away from the rotary reed 2, the shuttles are provided with permanent shuttle magnets 3 which are oriented transversely to the direction of translation of the shuttles and transversely to the warp threads 11.

Both above and below the path of transport of the shuttles 1 there is arranged a group of jointly driven multi-pole round magnets 40, 40' over the entire weaving width. Each of the round magnets 40, 40' is fastened to one end of a rotatably supported shaft 12, 12' on the other end of which a gear 18, 18' is mounted. The gears 18 and the gears 18' are connected via gears or a drive chain with each other and can be driven by a common drive. The round magnets 40, 40' have the shape of a truncated cone the angle of inclination of which is so selected that the circumferential surface of each round magnet extends parallel to the adjacent outer surface of the shuttle magnets 3. The drive group above and below the path of conveyance of the shuttles 1 is installed in separate housings 13, 13', a wall 15, 15' of which adjacent the shuttles 1 consists of a thin magnetically permeable material. One of the two housings 13, 13'—the upper housing 13 as shown in the drawing—is supported swingable around a shaft 10 on the loom and can be swung in clockwise direction around said shaft so that the sheds are readily accessible from the outside (see FIG. 1).

The shuttles 1 are provided, towards the rotary reed 2, with a nose-shaped projection 16 which projection is guided in a helical groove on the circumference of the rotary reed 2, said groove being formed by corresponding recesses 17 on the circumference of the reed disks 9. The helical groove formed by the recesses 17 has the same pitch as the helix formed by corresponding circumferential points of the individual reed disks 9. This mechanical coupling between rotary reed 2 and shuttle 1 serves to assure synchronism between the movement of the rotary reed 2 and thus the beating-up of the filling threads 14 on the one hand and the movement of translation of the shuttles 1 on the other hand. This synchronism can be disturbed by mechanical resistances, for instance by increased friction between shuttles 1 and warp threads 11, or by filling threads 14 being caught in the shed or by inertial forces occurring for instance upon a sudden stopping or upon the starting of the loom. Of course, the said coupling between the shuttles 1 and the reed disks 9 which serve as stop means is advantageous not only with the shuttle drive by permanent magnets which is shown in the drawing but in connection with all slip-sensitive and thus all electromagnetic shuttle drives.

Figure 2A:
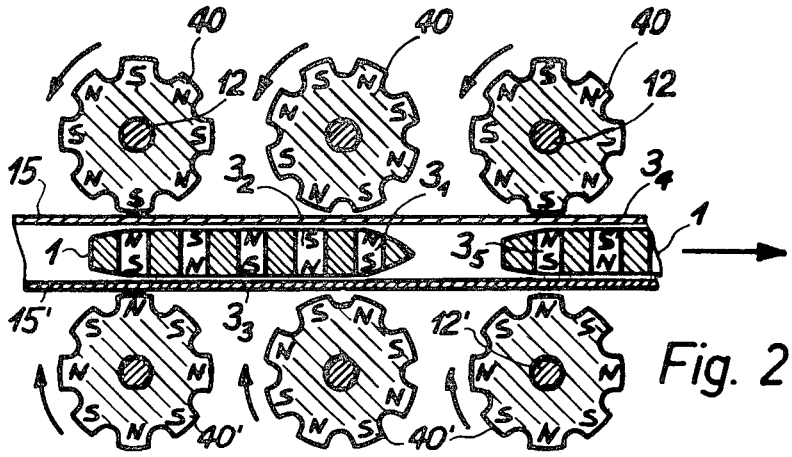
FIGS. 2*a* and 2*b* are sectional views, each taken along the line II—II of FIG. 1.
Figure 2B:
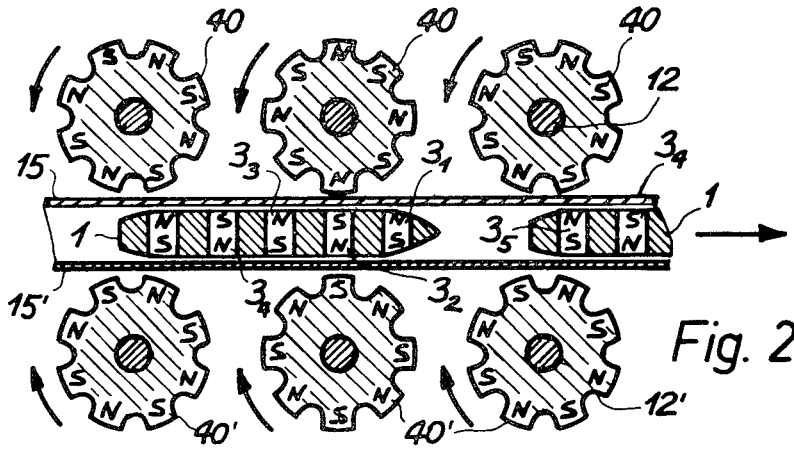

As shown in FIGS. 2*a* and 2*b*, the round magnets 40, 40' each has eight magnet poles and is so developed that in each case a north pole N follows a south pole S and vice versa. The shuttles 1 are provided over their length with a plurality of several—five shown in the drawing—shuttle magnets $3_1$ to $3_5$ which are the same distance from each other. The shuttle magnets are so oriented within the shuttle 1 that the first, third and fifth shuttle magnets $3_1$, $3_3$ and $3_5$ have their one pole—in the case shown in the drawing the north pole N—pointed upward and the second and fourth shuttle magnets $3_2$ and $3_4$ have their other pole—as shown in the drawing the south pole S—pointing upwards. The pitch of the shuttle magnets 3 corresponds to the pitch of the poles on the circumference of the round magnets 40, 40'.

The round magnets 40, 40' on the upper and lower sides of the path of conveyance of the shuttle 1 form, with respect to their movement of rotation, two groups which have a phase difference with respect to each other equal to ½ the pole pitch. The round magnets 40, 40' are so arranged that in each case one round magnet of the one phase position lies alongside one round magnet of the other phase position. The distances between centers of the round magnets 40, 40' are so selected that they correspond to 3.5 pitches of the shuttle magnets 3.

In each case two round magnets 40, 40' of the upper and lower drive groups are arranged along a vertical with respect to each other and have a phase difference of one pole pitch with respect to each other with regard to their rotary movement.

In the instantaneous condition of the shuttle transportation shown in FIG. 2*a* and with the direction of rotation of the round magnets 40, 40' in the direction indicated by arrows, each shuttle 1 is pushed primarily by the force acting between its rearmost shuttle magnet $3_5$ and the upper and lower round magnets 40, 40' adjacent same to the right in the direction of transport indicated by an arrow. At the same time the next round magnets 40, 40', as seen in the direction of transport, exerts a force on the first and second shuttle magnets $3_1$ and $3_2$ and pulls the shuttle 1 in the direction of transport.

When the round magnets 40, 40' have rotated ½ pole spacing from the position shown in FIG. 2*a*, the instantaneous condition shown in FIG. 2*a* is obtained. The shuttle 1 has almost moved out of the range of the left-hand round magnets 40, 40' as seen in the drawing and is pulled primarily by the round magnets 40, 40' shown in the center of the drawing and transported towards the round magnets shown to the right in the figure. When the last shuttle magnet $3_5$ passes through the middle round magnets 40, 40' there is again obtained the instantaneous condition shown in FIG. 2*a*, although to be sure with the difference that the shuttles 1 have in the meantime been transported towards the right by an amount equal to the length of the center to center distance between two adjacent round magnets 40, 40'.

In the embodiment shown in FIGS. 3, 4 and 5*a* through 5*d*, two groups of horseshoe-shaped permanent magents 41, 41' arranged above and below the shuttle conveyance path are used as drive elements for the shuttles 1. The horseshoe magnets 41, 41' are supported at the one end by rotary shafts 21, 21' oriented perpendicular to the direction of transport of the shuttles, the said rotation shafts each bearing a gear 22, 22' on their other end. The gears 22, 22' are connected with each other by intermediate gears which can be driven by a drive which is common to the upper and lower drive groups, or they are each driven by one drive chain per drive group.

The shuttles 1 are developed in a manner similar to that used in the embodiment of FIG. 1; the essential difference is that the shuttles are equipped with three permanent magnets 3 which are distributed uniformly over their length.

Figure 4:
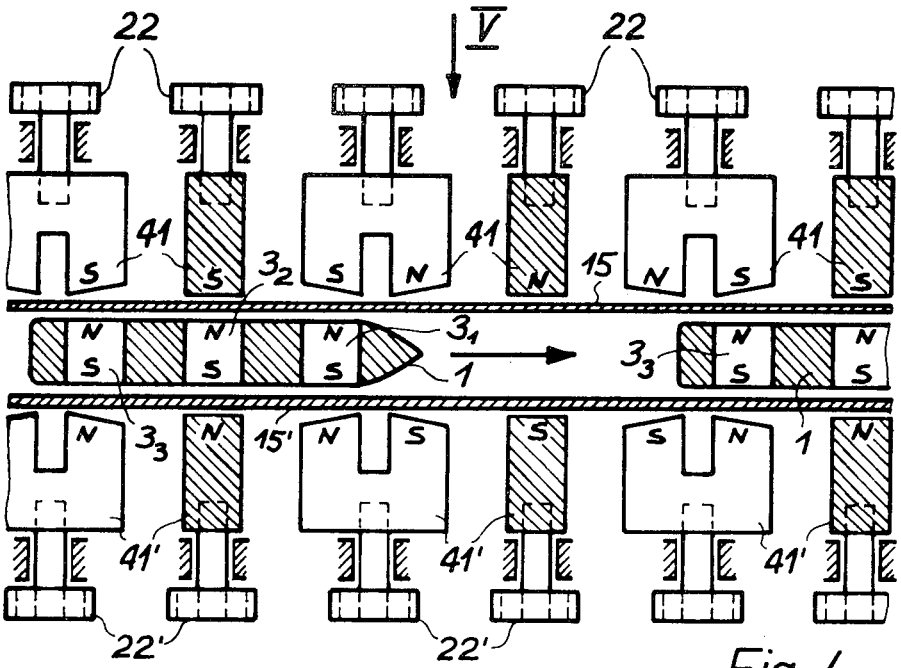
FIG. 4 is a sectional view taken along the line IV—IV of FIG. 3.

The horseshoe magnets 41, 41' are spaced uniformly apart and the axes of rotation of the horseshoe magnets of the upper and lower drive groups each lies along a straight line extending parallel to the path of transport of the shuttles. Furthermore, every horseshoe magnet 41 of the upper drive group is so associated with a horseshoe magnet 41' of the lower group that the axes of rotation of these two magnets are aligned with each other and that the magnetic fields of the two magnets extend in opposite directions to each other at each moment of their rotary movement. The horseshoe magnets 41, 41' are furthermore so oriented with respect to each other that each magnet of the upper and lower drive groups has a phase difference in its rotary movement of 90° with respect to the next following magnet in the direction of transport of the shuttles. In accordance with FIG. 3, the shuttle magnets 3 are so arranged that, in the rotated position of the horseshoe magnets 41, 41' transverse to the path of conveyance of the shuttles they are aligned with the one pole of the horseshoe magnets. As shown in FIG. 4, the pitch of the shuttle magnets 3, whose cross-section is the same size as that of the poles of the horseshoe magnets 41, 41', corresponds to the center-to-center distance of the horseshoe magnets less the normal distance between the axis of the horseshoe magnets and the axis of one of their legs (see FIGS. 4 and 5*a* through 5*d*).

In FIGS. 5*a* through 5*d* the manner of operation of the shuttle transport is shown schematically for four consecutive positions of rotation of the horseshoe magnets each rotated 90° in respect to each other. In the figures, the horseshoe magnets 41 of the upper drive group are shown in each case. These horseshoe magnets act, in accordance with FIGS. 3 and 4, in each case on the north pole of the shuttle magnets 3. The horsehoe magnets 41' of the lower drive group coincide with those of the upper drive group and act in each case on the south pole of the shuttle magnets 3.

In accordance with FIGS. 4 and 5*a* through 5*d* the transport of the shuttles during each transport phase takes place in each case by the action of the forces between in each case three successive horseshoe magnets 41, 41' of the upper and lower drive groups and the three shuttle magnets $3_1$ to $3_3$. The front and middle shuttle magnets $3_1$ and $3_2$, as seen in the direction of transport indicated by an arrow, are in each case under the action of opposite poles while the rear shuttle magnet $3_3$ is under the action of like poles of the horseshoe magnets 41, 41'. The front and middle shuttle magnets $3_1$ and $3_2$ are thus transported by attracting magnetic forces while the rear shuttle magnet $3_3$ is transported by repelling magnetic forces.

In the embodiment shown by way of example in FIGS. 6 and 7*a* through 7*d*, two groups of horseshoe-shaped permanent magnets 42, 42' arranged above and below the path of transport of the shuttles are used as drive elements for the shuttles 1. The horseshoe magnets 42, 42' are fastened to bearing arms 19 and 19' respectively. The bearing arms 19 and 19' are each rotatably supported on a cam 23 and 23' respectively firmly mounted on a drive shaft 20 and 20' respectively. The drive shafts 20 and 20' are arranged parallel to the path of transport of the shuttles. Upon rotation of the drive shafts the horseshoe magnets carry out a stroke. The drive shafts 20 and 20' of the upper and lower drive groups can be driven by a common drive. The horseshoe magnets 42, 42' are so oriented that the magnetic fields of all horseshoe magnets extend parallel to each other. In each case one horseshoe magnet 42, 42' of the upper and lower drive groups respectively are arranged aligned with each other along a vertical. The stroke of each such pair of horseshoe magnets takes place synchronously and with a phase difference of 180°, or in other words two magnets of a pair of magents move simultaneously away from the path of transport, simultaneously reach the point of their maximum deflection, move simultaneously towards the path of transport and simultaneously reach the point of their minimum deflection.

The shuttles 1 are developed in the same manner as in the case of the embodiment of FIG. 1, the essential difference residing in the arrangement of the shuttle magnets 3. Each shuttle 1 bears at its front and rear ends a separate shuttle magnet 3, the shuttle magnets being so oriented that their magnetic field extends horizontally and thus parallel to the outer magnetic field of the horseshoe magnets 42, 42' and opposite to it.

Thus in operating condition the north pole of one shuttle magnet lies in each case between the two south poles of a pair of horseshoe magnets and the south pole of the shuttle magnet lies between the two north poles of a pair of horseshoe magnets. The length of the shuttle magnets 3 corresponds to the outside dimension between the two legs of a horseshoe magnet 42, 42', and the width of the shuttle magnets 3 corresponds to the width of the horseshoe magnets 42, 42'. The center distance between the two shuttle magnets corresponds to 2.5 times the center distance between the horseshoe magnets.

In FIGS. 7*a* through 7*d* the manner of operation of the transport of the shuttles is shown schematically in four different phases. Each horseshoe magnet 42, 42' is provided with an arrow which indicates in what direction the magnet in question is moved directly after the instantaneous condition shown. Since the lower drive group represents, with respect to arrangement, orientation, and movement of the horseshoe magnets 42', an exact mirrow image of the upper drive group and thus of the horseshoe magnets 42, in each case only the horseshoe magnets 42 of the upper drive group have been shown in FIGs. 7*b* through 7*d*.

The drive of the shuttles in this embodiment is effected by the forces of attraction between opposite magnet poles. The horseshoe magnets 42, 42' experience such a stroke movement that they carry out an approximately sinusoidal oscillation, the same pair of magnets having the smallest distance from one of the two shuttle magnets always attracting said shuttle magnet and thus the shuttle in the direction of transport indicated by an arrow.

Figure 7A:
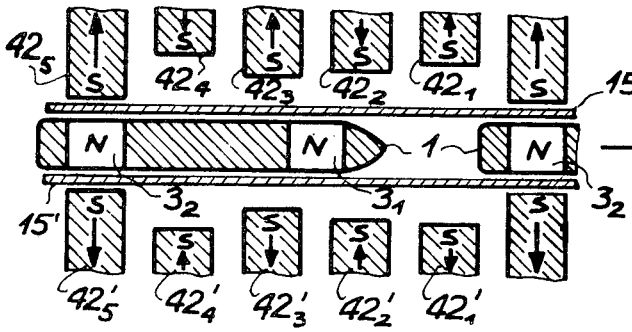
FIGS. 7*a* through 7*d* are each a sectional view taken along the line VII—VII of FIG. 6.
Figure 7B:
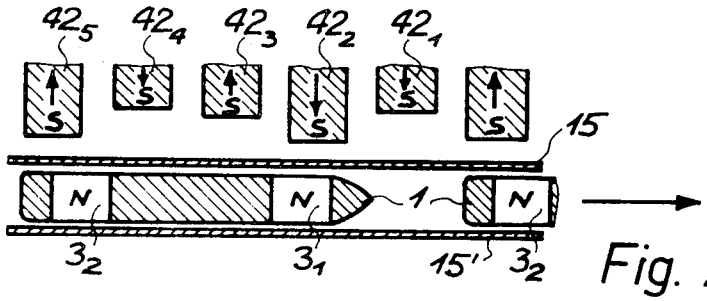
Figure 7C:
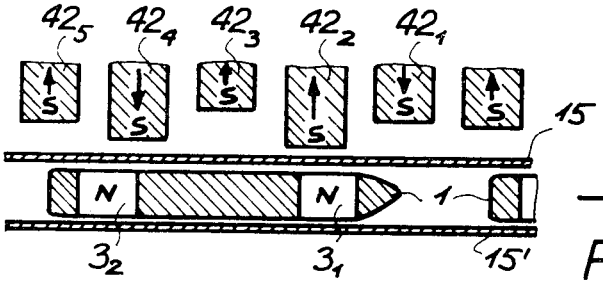
Figure 7D:
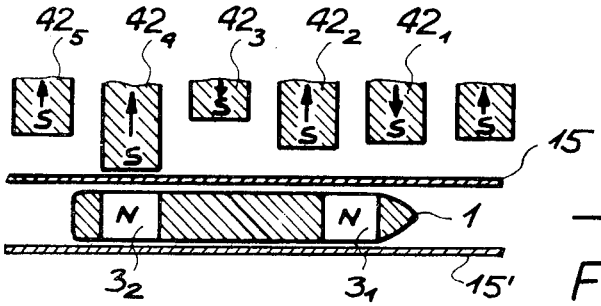

In the instantaneous condition shown in FIG. 7*a* the shuttle magnet $3_1$ is under the action of the magnet pairs $42_2$, $42'_2$ and $42_3$, $42'_3$ and the shuttle magnet $3_2$ is under the action of the pair of magnets $42_5$, $42'_5$. Upon further rotation of the drive shafts 20 and 20' (FIG. 6), the pairs of magnets $42_5$, $42'_5$ and $42_3$, $42'_3$ move away from the shuttle and the pair of magnets $42_2$, $42'_2$ moves towards the shuttle. In this way the force of attraction of the last mentioned pair of magnets on the shuttle magnets $3_1$ becomes greater than the sum of the forces of attraction of the pair of magnets $42_3$, $42'_3$ on the shuttle magnet $3_1$ and of the pair of magnets $42_5$, $42'_5$ on the shuttle magnet $3_2$. In this way the shuttle is transported into the position shown in FIG. 7*b*. Thereupon the pairs of magnets $42_4$, $42'_4$ and $42_2$, $42'_2$ move towards the shuttle. In this way the shuttle is transported by the action of the said pairs of magnets on the shuttle magnets $3_2$ and $3_1$ into the position shown in FIG. 7*c*. Thereupon the pair of magnets $42_4$, $42'_4$ is moved further towards the shuttle and transports the latter, by the force on the shuttle magnet $3_2$, into the position shown in FIG. 7*d*. The shuttle has thus been transported by a length corresponding to the pitch of the horseshoe magnets and the cycle described starts all over again.

In the case of the embodiment shown in FIGS. 8, 9 and 10, separate drive shafts 25, 25' arranged above and below the path of conveyance of the shuttles and parallel to it are used as drive for the shuttles 1, and the said drive shafts are provided with permanent bar magnets 43, 43' equally spaced apart and extending in radial direction through the central axis of the drive shafts. Successive bar magnets are in each case turned by the same angle so that the penetration surfaces of the magnets through the shell of their drive shaft lie in each case on a helix. The orientation of the bar magnets 43, 43' within their drive shaft 25 and 25' respectively is so selected that the individual magnet poles also form a continuous helix. The upper drive shaft 25 and the lower drive shaft 25' are entirely identical and are so mounted on the loom that the magnetic fields of every two bar magnets 43, 43' of the upper and lower drive shafts which correspond to each other extend at each moment parallel to each other. The two drive shafts 25, 25' are provided at their one or both ends with gears (not shown) which are coupled with a common drive.

The shuttles 1 are developed in a manner similar to the embodiment of FIG. 1, the essential difference consisting of the arrangement of the shuttle magnets 3. Each shuttle 1 bears at its front and rear ends a shuttle magnet 3, these magnets being so oriented that their magnetic field extends in vertical direction. The magnetic fields of the two shuttle magnets $3_1$, $3_2$ extend in opposite directions to each other. The center to center distance between the two shuttle magnets is so selected that it corresponds to the center to center distance between two bar magnets 43 or 43' which are 180° apart.

Figure 9:
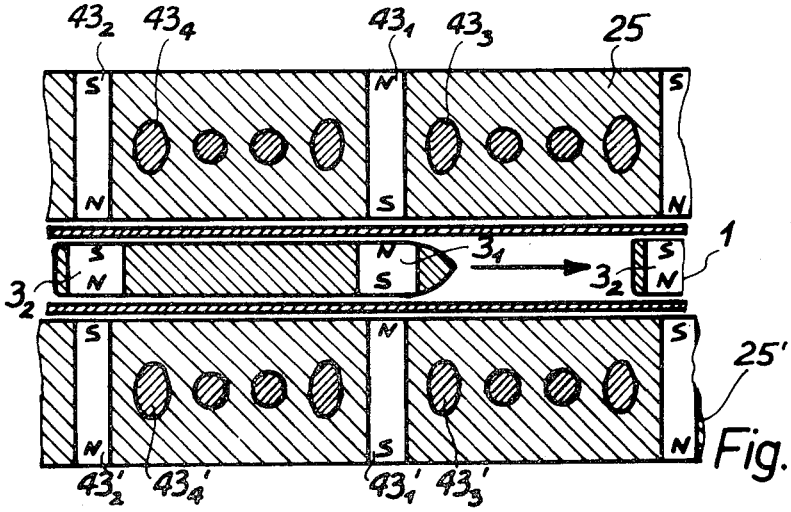
FIG. 9 is a view in cross-section taken along the line IX—IX of FIG. 8.
Figure 10:
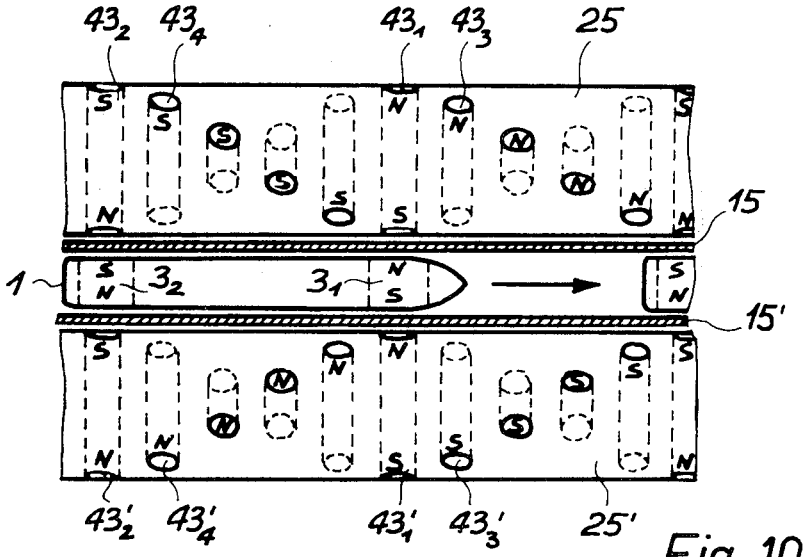
FIG. 10 is a schematic view seen in the direction of the arrow X in FIG. 8.
Figure 5A:
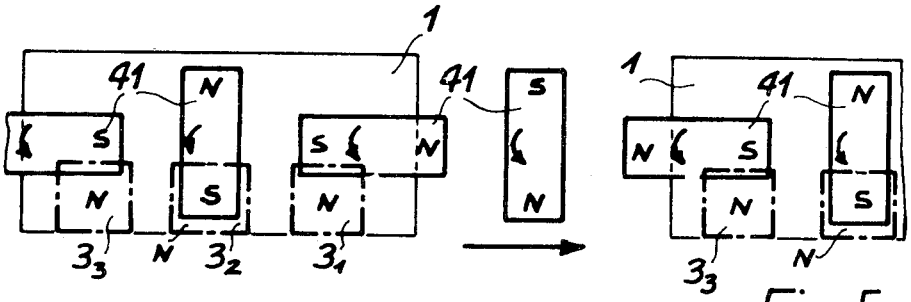
FIGS. 5*a* through 5*d* are each schematic views seen in the direction of the arrow V in FIG. 4.
Figure 5B:
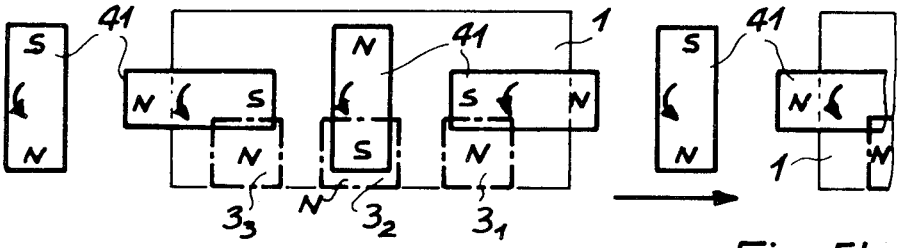
Figure 5C:
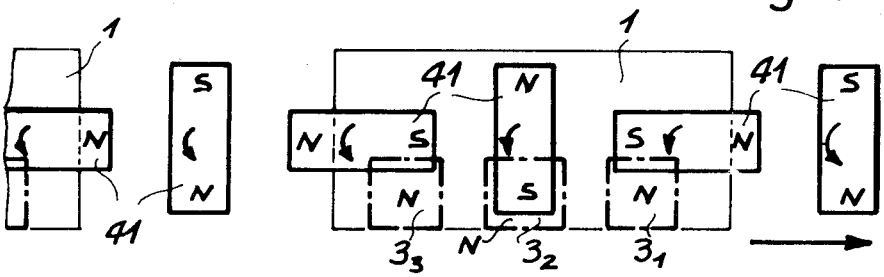
Figure 5D:
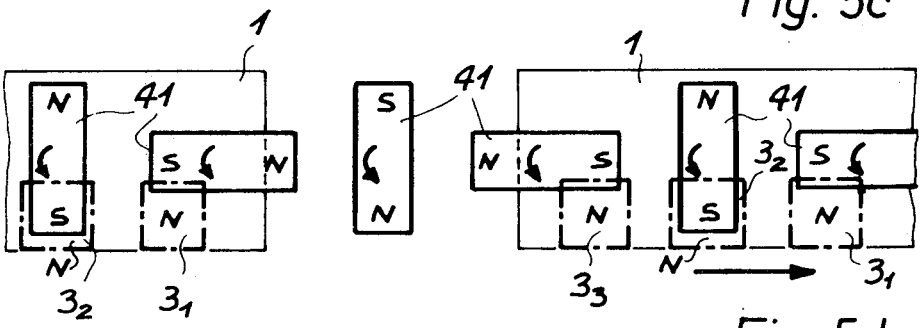

In FIGS. 9 and 10 the same instantaneous position of the transport of the shuttle has been shown, in FIG. 9 in sectional view and in FIG. 10 in a view as seen from the heddles 5, the housing 13, 13' surrounding the upper and lower drive groups being omitted from this last mentioned view, except for the wall 15, 15'.

As can be noted from FIGS. 9 and 10, the transport of the shuttles 1 in the direction of transport indicated by an arrow is effected by the forces of attraction between opposite magnet poles. In the instantaneous condition shown in these figures, the two shuttle magnets $3_1$ and $3_2$ are within the range of force of the bar magnets $43_1$, $43'_1$ and $43_2$, $43'_2$. Upon further rotation of the drive shafts 25 and 25' in the direction indicated by arrows in FIG. 8, the poles of the bar magnets $43_1$, $43'_1$ and $43_2$, $43'_2$, move away from the shuttle magnets $3_1$ and $3_2$. At the same time however one pole each of the bar magnets $43_3$, $43'_3$ and $43_4$, $43'_4$ is turned towards the path of transport of the shuttles. In this way the shuttle magnets come into the field of force of the bar magnets $43_3$, $43'_3$ and $43_4$, $43'_4$ and are conveyed further by the latter by a distance equal to one spacing of the bar magnets. All further transportation steps take place in analogous manner.

Figure 8:
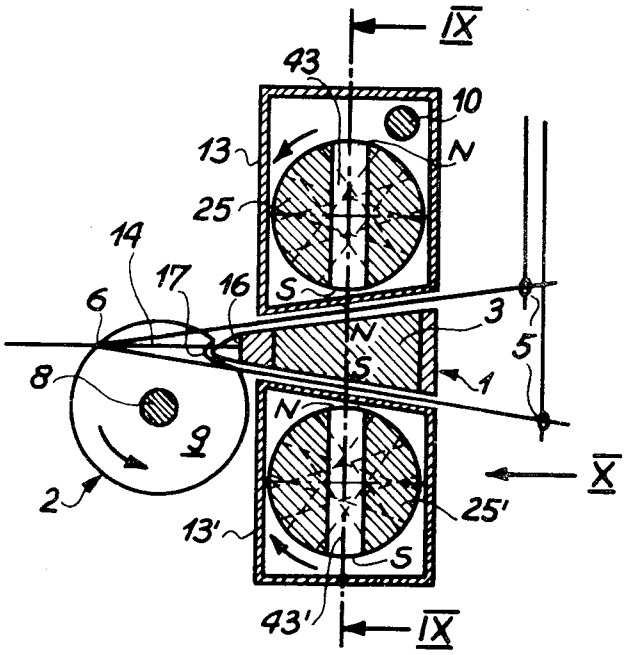
FIG. 8 is a vertical view in cross-section of a third embodiment of detail referring to FIG. 1.
Figure 6:
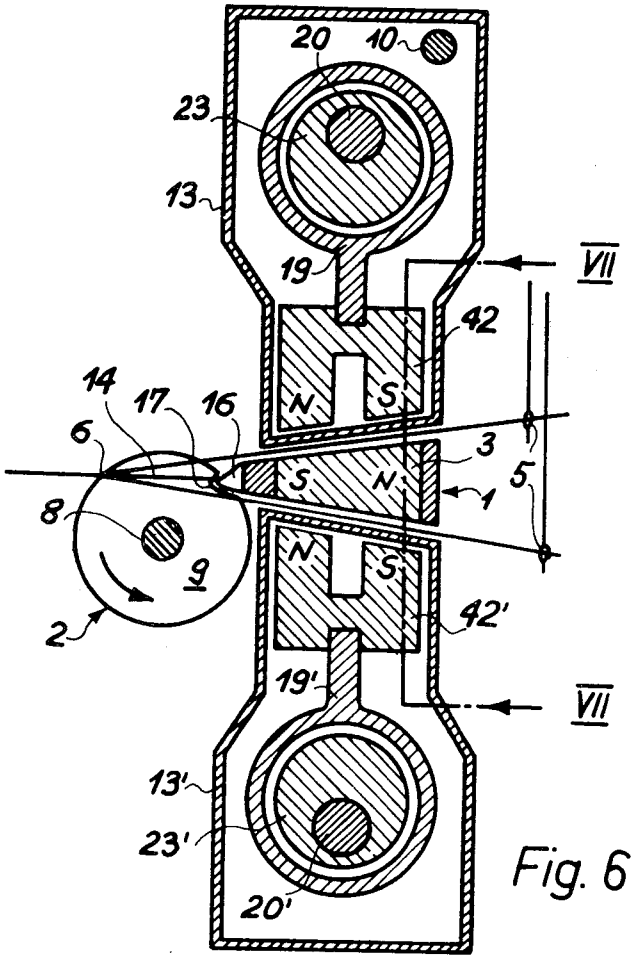
FIG. 6 is a vertical view in cross-section of a second embodiment of a detail as compared with FIG. 1.

Instead of the drive shafts 25, 25' shown in FIGS. 8 amd 9 with the bar magnets 43, 43' fitted in them, individual multi-pole round magnets arranged one behind the other on two drive shafts extending parallel to the path of transport of the shuttles can also be used.

In all the illustrative embodiments described the shuttles are provided with magnets. Of course instead of the shuttle magnets, non-permanently magnetized structural parts of ferromagnetic material can also be used without thereby making any change in the shuttle drive device in accordance with the invention.

It will be appreciated that various changes and/or modifications may be made within the skill of the art without departing from the spirit and scope of the invention illustrated, described, and claimed herein.

What is claimed is:

1. An arrangement for the transporting of shuttles filled with filling thread through the sheds of an undulated shed-type loom by fixed permanent magnetic means along the shuttle path of the loom, said magnetic means capable of producing varying magnetic fields with resultant components of force on the shuttles over the entire weaving width of the loom as the shuttles move along the shuttle path, and having means for the beat-up of the filling threads introduced against the fell of the cloth, the beat-up of the filling threads advancing synchronously with the movement of the transportation of the shuttles over the width of the loom: comprising a mechanical coupling means acting between the shuttles and the beat-up means in order to maintain the synchronism between the movement of the transport of the shuttles and the beating up movement of the beat-up means.

2. The arrangement of claim 1 in which the beat-up means are formed by a rotary reed which is arranged parallel to the path of the shuttles and comprises a drivable drive shaft and reed disks mounted turned from each other by the same central angle on said drive shaft at fixed distances apart, points on the circumference of the individual reed disks which correspond to each other lying along a helix extending on the circumference of the rotary reed, said helix having a given pitch, and in which the said mechanical coupling means are formed by an extension piece arranged on the side of the shuttles facing the rotary reed on the one hand by a helical groove arranged on the circumference of the rotary reed and intended for the guiding of the projection piece on the other hand, the pitch of the said groove corresponding to the pitch of the said helix at the circumference of the rotary reed.

3. The arrangement of claim 1 in which the magnetic fields act on ferromagnetic parts fixedly incorporated in the shuttles as shuttle magnets, said magnetic fields being formed by a plurality of permanent shuttle drive magnets which are arranged at fixed bearings along two sides of the path of the shuttles, the distances between said bearings being less than the length of a shuttle, said drive magnets being operatively associated with drive means for moving the drive magnets relative to their bearings whereby over the entire weaving width there are present local magnetic fields of varying intensity producing a resultant component of force lying in the direction of movement of the shuttles on the shuttle magnets.

4. The arrangement of claim 3 in which the shuttle drive magnets are formed by multiple round magnets rotatably supported parallel to the transverse direction of the path of the shuttles, the round magnets being so developed that in each case one pole of one type follows a pole of the other type on their circumference, and in which the shuttle magnets developed as bar magnets are so arranged that their longitudinal axis extends perpendicular to the path of the shuttles and perpendicular to the axis of rotation of the round magnets.

5. The arrangement of claim 4 in which, in the case of each shuttle, the magnetic fields of adjacent shuttle magnets have an opposite direction, the pitch of the shuttle magnets corresponding to the pitch of the poles at the circumference of the round magnets, the center-to-center distance of the round magnets being so selected that it is an odd multiple plus one-half pitch of the shuttle magnets, and on each side of the path of the shuttles the round magnets form with respect to their movement of rotation two groups one of which has a phase difference with respect to the other equal to one-half of the pitch of the shuttle magnets and in each case one round magnet of the one group is arranged alongside a round magnet of the other group.

6. The arrangement of claim 5 in which each of the round magnets is mounted on a shaft which is rotatably supported parallel to the transverse direction of the path of the shuttles and in which the drive means for the round magnets are formed in each case by a first gear mounted on each of these shafts, by second gears connecting the first gears with each other and by a drive which is common to all gears.

7. The arrangement of claim 3 in which the drive magnets are formed by horseshoe-shaped magnets rotatably supported perpendicular to the longitudinal and transverse directions of the path of the shuttles, and the shuttle magnets developed as bar magnets are so arranged that their longitudinal axis extends parallel to the axis of rotation of the horseshoe-shaped magnets.

8. The arrangement of claim 7 in which the magnetic fields of all shuttle magnets have the same direction, the pitch of the shuttle magnets being equal to the center-to-center spacing of the horseshoe-shaped magnets minus the normal distance between the central axis of the horseshoe-shaped magnets and the central axis of one of their legs and each horseshoe-shaped magnet having a phase difference with respect to its motion of rotation of +90° with respect to the next following horseshoe-shaped magnet in the direction of transport.

9. The arrangement of claim 8 in which each of the horseshoe-shaped magnets is mounted on a shaft supported rotatably perpendicular to the longitudinal and transverse direction of the path of the shuttles, and the drive means for the horseshoe-shaped magnets are formed by in each case a first gear mounted on said shafts, by second gears connecting the first gears with each other, and by a drive which is common to all gears.

10. The arrangement of claim 3 in which the drive magnets are formed of horseshoe-shaped magnets supported for stroke displacement perpendicular to the longitudinal and transverse directions of the path of the shuttles and oriented parallel to the transverse direction, and the shuttle magnets are so arranged that their longitudinal axis extends parallel to the transverse direction of the path of the shuttles.

11. The arrangement of claim 40 in which the magnetic fields of all shuttle magnets have the same direction, and the pitch of the shuttle magnets is equal to 2.5 times the pitch of the horseshoe-shaped magnets.

12. The arrangement according to claim 11 in which each of the horseshoe-shaped magnets is mounted on a separate lift part provided with a cylindrical bore hole which extends in the longitudinal direction of the path of the shuttles, and the drive means for the horseshoe-shaped magnets are formed by in each case a separate disk rotatably supported in said bore of the lift parts, by in each case a separate drive shaft which bears the disks on both sides of the path of the shuttles, and by a drive common to the two drive shafts, the disks being mounted eccentrically on their drive shaft.

13. The arrangement of claim 3 in which the drive magnets are formed by bar magnets which are supported for rotation parallel to the longitudinal axis of the path of the shuttles and oriented parallel to the transverse direction of the shuttle path; the shuttle magnets so arranged that their longitudinal axis extends perpendicular to the longitudinal and transverse directions of the path of the shuttles; and each bar magnet is turned by a given central angle with respect to the next following bar magnet in the direction of transport so that the poles of all bar magnets lie on each side of the path of the shuttles along a continuous helix.

14. The arrangement of claim 13 in which the magnetic fields of adjacent shuttle magnets of each shuttle are of opposite direction and the pitch of the shuttle magnets corresponds to the center-to-center distance between every two bar magnets which are 180° apart from each other.

15. The arrangement of claim 14 in which the bar magnets ae mounted in separate radial bore holes of a shaft rotatably supported on each of the two sides of the path of the shuttles parallel to the longitudinal direction of the path, and the drive means for the bar magnets are formed by said shafts and by a drive common to the two shafts.

16. The arrangement of claim 3 in which each of the drive magnets on each of the two sides of the path of the shuttles are arranged in a separate housing, each of these housings towards the path of the shuttle having a thin wall formed of a magnetically permeable material, and at least one of the two housings together with the drive magnets arranged therein swingable away from the path of the shuttles around a swiven axis arranged parallel to the path of the shuttles.

* * * * *